United States Patent [19]

Gueret

[11] Patent Number: 4,844,251

[45] Date of Patent: Jul. 4, 1989

[54] CONTAINER MEANS FOR SEPARATELY STORING AT LEAST TWO PRODUCTS TO BE BROUGHT INTO CONTACT AT THE TIME OF USE

[75] Inventor: Jean-Louis Gueret, Paris, France

[73] Assignee: L'Oreal, Paris, France

[21] Appl. No.: 82,609

[22] Filed: Aug. 7, 1987

[30] Foreign Application Priority Data

Aug. 12, 1986 [FR] France ..... 86 11619

[51] Int. Cl.[4] ..... B65D 25/08

[52] U.S. Cl. ..... 206/222; 206/229; 206/440; 206/823; 220/20.5; 239/34; 401/134; 604/87

[58] Field of Search ..... 206/219–222, 206/229, 823, 495, 440, 207, 210; 220/20, 20.5; 215/DIG. 8; 401/132–135; 239/34, 43, 44, 57, 58; 604/56, 82, 87, 88; 222/80–83, 85–90, 135, 83.5, 206, 215

[56] References Cited

U.S. PATENT DOCUMENTS

| | | | |
|---|---|---|---|
| 1,898,236 | 2/1933 | Blank | 206/440 |
| 3,150,049 | 9/1964 | Emony | 206/823 X |
| 3,340,336 | 9/1967 | Bender | 206/220 X |
| 3,548,562 | 12/1970 | Schwartzman . | |
| 3,618,751 | 11/1971 | Rich | 206/219 |
| 3,756,571 | 9/1973 | Winberg | 206/221 |
| 3,889,804 | 6/1975 | Ravich . | |
| 3,891,331 | 6/1975 | Avery . | |
| 4,008,803 | 2/1977 | Smith | 206/220 |
| 4,042,109 | 8/1977 | Barcan . | |
| 4,247,001 | 1/1981 | Wiegner | 206/222 |
| 4,306,679 | 12/1981 | Dusek et al. . | |
| 4,526,320 | 7/1985 | Von Phillip et al. | 239/43 |
| 4,693,711 | 9/1987 | Bremer et al. | 604/87 X |

FOREIGN PATENT DOCUMENTS

| | | |
|---|---|---|
| 554823 | 5/1983 | Australia . |
| 8214314 | 9/1982 | Fed. Rep. of Germany . |
| 3218480 | 6/1983 | Fed. Rep. of Germany . |
| 3300088 | 11/1983 | Fed. Rep. of Germany . |
| 3230357 | 2/1984 | Fed. Rep. of Germany . |
| 8402892 | 8/1984 | PCT Int'l Appl. . |
| 1373968 | 11/1974 | United Kingdom . |
| 1533552 | 11/1978 | United Kingdom . |
| 2012714 | 8/1979 | United Kingdom . |

OTHER PUBLICATIONS

French Search Report of May 14, 1987.

*Primary Examiner*—Stephen Marcus
*Assistant Examiner*—Bryon Gehman
*Attorney, Agent, or Firm*—Cushman, Darby & Cushman

[57] ABSTRACT

A casing includes a body having an opening closed by a film which can be torn off in one piece; the body is formed into two adjacent compartments one of which receives a basic product and the other having a dish receiving area and a dish received therein for an additional product; the dish is provided with a perforator for perforating a cover provided over the compartment section housing the dish; the portion of the compartment for the dish remote from the film and cover is shaped to be deformable by manipulation to allow the cover to be perforated and the additional product to be ejected from the dish into the compartment.

8 Claims, 3 Drawing Sheets

CONTAINER MEANS FOR SEPARATELY STORING AT LEAST TWO PRODUCTS TO BE BROUGHT INTO CONTACT AT THE TIME OF USE

FIELD OF THE INVENTION

The present invention relates to means for separately storing at least two products which are only intended to come into contact with each other at the time of use, this means offering the user the facility of easily bringing the products into contact.

A first aspect of the present invention envisages this contact occurring upon impregnation of at least one product—which in the case in point is constituted by an element of an absorbent material—by at least one product of a liquid or pasty consistency, or even a pulverulent product.

The absorbent elements may consist of pads for the application of cosmetic substances (for example, masks, or fluids for facial care) or perfumes, or of pads or compresses for the application of pharmaceutical substances, disinfectants or similar, it then being possible for the user to take such elements from their packaging so that they can be used. Storage may also be envisaged for insecticides, deodorants, perfumes or similar substances intended to be diffused in the atmosphere; in that case, the associated absorbent pads will not be withdrawn from their casings after impregnation, the latter being perforated near at least one side of the pad contained therein.

Such a device proves necessary in the case where the applicator element is made of a material which would deteriorate if it were stored too long in an impregnated state. This is, in particular, the case with pads of non-woven materials receiving cosmetic or perfumery substances.

Moreover, it is sometimes desirable to store the impregnating products separately, in particular if they are unstable or yet again if it is important for them to be kept away from air, which can be the case with substances intended to impregnate medical compresses.

A second aspect of the invention envisages bringing the products into contact by straightforwardly mixing; they can have a liquid or pasty consistency or can be constituted by a pulverulent material. There are many fields of application for means of this type.

Thus, it is frequently necessary, for example in order to obtain an active product intended for a pharmaceutical treatment, to bring a solid product in a pulverulent form into contact with a liquid product which may, in particular, be a solvent of the solid in question. If the solution of the solid in the liquid is unstable and cannot be kept for a long time while preserving its properties, it is necessary to store the liquid separately and to effect the contact only at the time of use of this solution. Rather than storing the solid product and the liquid product separately, it is preferable for the two products to be stored within one and the same unit, and for a particular manipulation applied to the storing means to allow the contact to be established at the time of use.

Possible applications of the separate storage of two liquids which should only be mixed at the time of use include, (i) for example in the field of hair dyeing, a colourant and an oxidising agent, and (ii) the separate storage of liquid and/or pulverulent cosmetic proudcts in the case of particular cosmetic formulations.

PRIOR ART

Diffuser devices have already been proposed, for example in West German Patent No. 3 218 480 and West German Utility Model No. 82-14314, in particular for insecticides, wherein the impregnation of an absorbent pad by the insecticide product is only effected when the user wishes to use the diffuser device.

The device of German Patent No. 3 218 480 comprises a casing constituted by three successive compartments open at their upper portion, the two end compartments being capable of being folded down on the central compartment, wherein a dry absorbent pad is disposed. One of the end compartments serves to accommodate a capsule filled with insecticide and is obturated by a perforable cover. At the time of use the user folds this compartment down on the central compartment, and the cover of the capsule is thus perforated by a perforator carried by the central compartment in that the insecticide product impregnates the abosrbent pad. The second end compartment comprises a perforated bottom; once it is folded down on the central compartment, it serves as a diffuser. In a variant, the perforator is carried by the diffuser compartment. In that embodiment, the active products are stored in separate capsules or dishes which, at the time of manufacture, have to be added to a storage facility of a relatively complicated structure.

The device of German Utility Model No. 82-14314 comprises a casing with a perforated lateral side, on the bottom of which is an absorbent pad. A support to be fixed on this casing provides, on the one hand for several perforators which are situated in the assembled position above the absorbent pad and whose point is directed outwardly, and, on the other hand, for sliding capsules equal in number to that of the perforators, which are filled with the insecticide product and are normally closed by a cover. In this storage position, the capsules are turned above the associated perforator, so that their cover should be at a distance from the latter. When the user wishes to use a capsule, he presses on its end which is accessible from the outside, to cause it to slide until the cover becomes perforated by the perforator. In this embodiment, the casing has a complicated structure, so that it can, in particular, ensure suitable sliding of the capsules; it is therefore expensive; it is, moreover, necessary to position separable capsules therein and this complicates the manufacture.

Applicants' Assignees have tried to obtain units having a much simpler structure than that proposed in the prior art in particular with a view to speeding up the filling for storage and to reducing the cost of the finished product.

OBJECTS OF THE INVENTION

It is an object of the present invention to ensure that the casing comprises at least one deformable wall zone, directly forming an integral part of the casing, the manipulation of the deformable wall producing the perforation of the cover of a dish by the associated perforator; advantageously, this wall of the casing constitutes a sunken zone receiving one of the products—an impregnation product in the case where the unit is intended to allow the impregnation of an absorbent element—and being obturated in the conventional way by a thermoweldable or heat sealing cover placed within the casing.

It is a further object of the invention, to form the perforator as an independent component accommodated in a compartment delimited by the partly deformable wall, in particular in the compartment containing the impregnation substance. The structure of the means is thus simplified since the perforator no longer has to be formed by a protuberance of the casing, the casing may, therefore, comprise only a thin wall, so much so that it is advantageous to make said casing by thermoforming.

SUMMARY OF THE INVENTION

The present invention is a new industrial product constituted by means for the separate storage of at least one basic product and at least one additional product intended to be combined with the said at least one basic product only at the time of use, the said means comprising a casing which contains, on the one hand the said basic product or products and, on the other hand at least one dose of at least one additional product, each dose being accommodated in a dish carried by said casing and closed by a cover disposed within the casing and being perforable under the action of a perforator normally placed at a distance in relation to said cover, the casing having at least one movable wall zone accessible from outside, the said movable zone constituting the means making it possible to produce the relative displacement of the corresponding perforator and of its associated cover to effect the perforation of the cover, characterised in that the at least one movable wall zone forms an integral part of the casing, and the casing is made of a sufficiently flexible material for the at least one movable wall zone to be at least partly deformable under the user's manual action.

Preferably, each movable wall zone constitutes a sunken wall zone of the casing delimiting one dish.

In a preferred embodiment of the present invention each perforator constitutes an independent element disposed freely in the zone of the casing surrounded by the associated movable wall zone, that is to say in the internal space of the dish in the above case.

In fact, in this case each perforator may consist of a tubular element disposed axially in the associated dish.

In a particular embodiment each dish is delimited by a bottom which is substantially parallel to the associated cover and by a lateral wall constituted by an alternation of frustoconical zones and zones forming a bellows. The associated perforator can in that case have a frustoconical shape flaring towards the cover.

According to a particular characteristic of the present invention, the wall zone of the casing situated opposite the cover, on the other side from the perforator, is reinforced or protected by an added plate. This measure prevents an unintended perforation of the casing wall when the products are brought into contact.

One can also dispose in the casing a movable element, in particular a ball, capable of agitating the product or products having a liquid to pasty, or pulverulent consistency, when the products contained in the casing are brought into contact.

In the case where the resultant product or products, from the combination of the basic product or products and of the additional product or products, have to be removed for use, the casing comprises at least one detachable wall zone for the extraction of the resultant product or products. In a particular embodiment, the casing consists of a hollow body comprising an opening surrounded by an annular bearing surface to which an obturating film is thermowelded to be torn off in one piece; the film constitutes the above mentioned detachable wall zone; the body delimits at least two compartments, at least one receiving a basic product, and the other, or others each being formed by a dish receiving an additional product and a perforator; the cover associated with the or each said dish is spaced from the obturating film. The body can, in particular, comprise a bottom provided with a set back dividing it into two parts, substantially parallel to the obturating film, the one associated with the compartment receiving the basic product or products, and the other situated nearer to said film having at least one outward deformation constituting a said dish.

In a first variant according to the present invention, the or each basic product is an element of an absorbent material and the or each additional product is a product intended for the impregnation of the or each said element of absorbent material. In particular, each element of absorbent material can be disposed in a compartment of the casing, spaced from at least one wall delimiting the compartment.

The elements of absorbent materials are in particular constituted by applicator pads which can consist of a non-woven element capable of being folded back around a supporting grid of a flexible material.

In a second variant according to the present invention, the or each basic product is constituted by a pulverulent substance and the or each additional product is constituted by a liquid substance.

It is preferable for the casing to be made by the thermoforming of a laminated material.

BRIEF DESCRIPTION OF THE DRAWINGS

In order that the present invention may more readily be understood, two embodiments thereof, represented in the attached drawings, will now be described by way of a purely illustrative and non-restrictive example. In these drawings.

DESCRIPTION OF THE PREFERRED EMBODIMENTS

Figure 1:
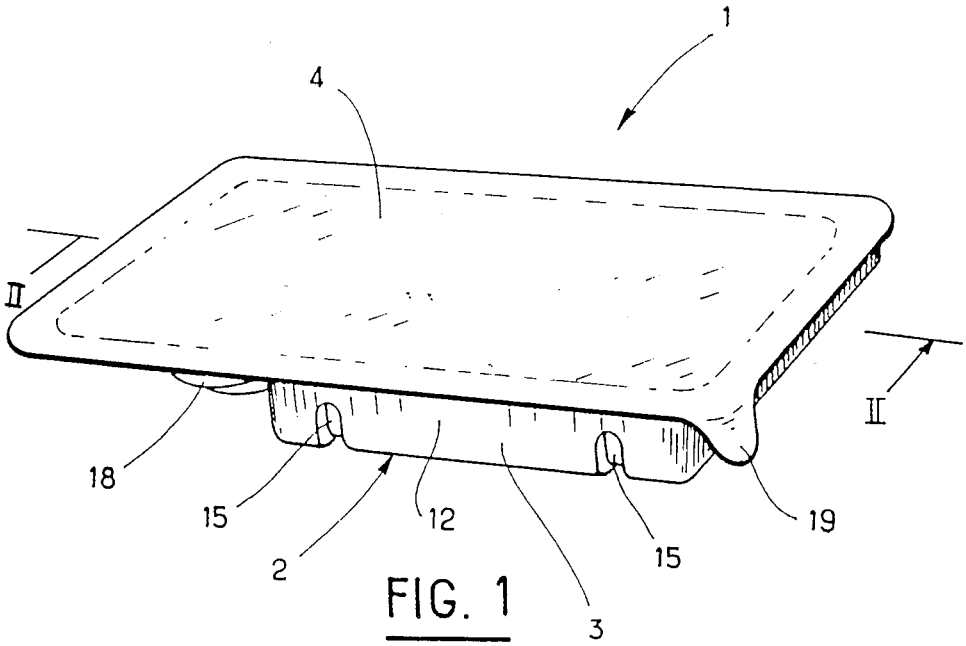
FIG. 1 is a perspective view of a first embodiment of the invention, in the storage condition.

Reference to the attached drawings, will reveal means 1 for the separate storage of an absorbent applicator pad and a liquid cosmetic substance intended to impregnate it with a view to application to the skin; this impregnation is effected automatically just before use.

The storage means 1 comprises a casing 2 which is constituted by a body 3 which, before use, is closed by a film 4 able to be torn off in one piece. The casing 2 serves, on the one hand, to accommodate in a first compartment 6 an applicator pad 5 and, on the other hand, to act as reservoir in a second compartment 8 for the dose of the liquid cosmetic product 7 which is to impregnate the applicator pad 5. During storage the second compartment 8 is closed by an inner cover 9 and is associated with a perforator 10 intended to perforate the cover 9 at the appropriate time.

The body 3 of the casing 2 comprises a bottom wall and a lateral wall designated as a whole by the reference numerals 11 and 12 respectively, the lateral wall 12 being bent back at right angles towards the outside so as to constitute an annular bearing surface or flange 13 to which the film 4 can be fixed as will be described below. The bearing surface 13 may, if desired, comprise external fastening projections (not shown) facilitating the positioning of the film 4 thereon.

The bottom wall 11 is constituted by an elongate rectangular strip having at approximately one third of its length a set back 14 at right angles along a line parallel to its small sides. Thus there are two bottom zones 11*a*, 11*b*, with a larger and smaller area respectively, the zone 11*a* of the bottom wall 11 delimiting, with the set back 14 and the adjacent zone of the lateral wall 12, the deeper cavity of the casing 2, that is to say the compartment 6 intended to receive the applicator pad 5.

Figure 4:
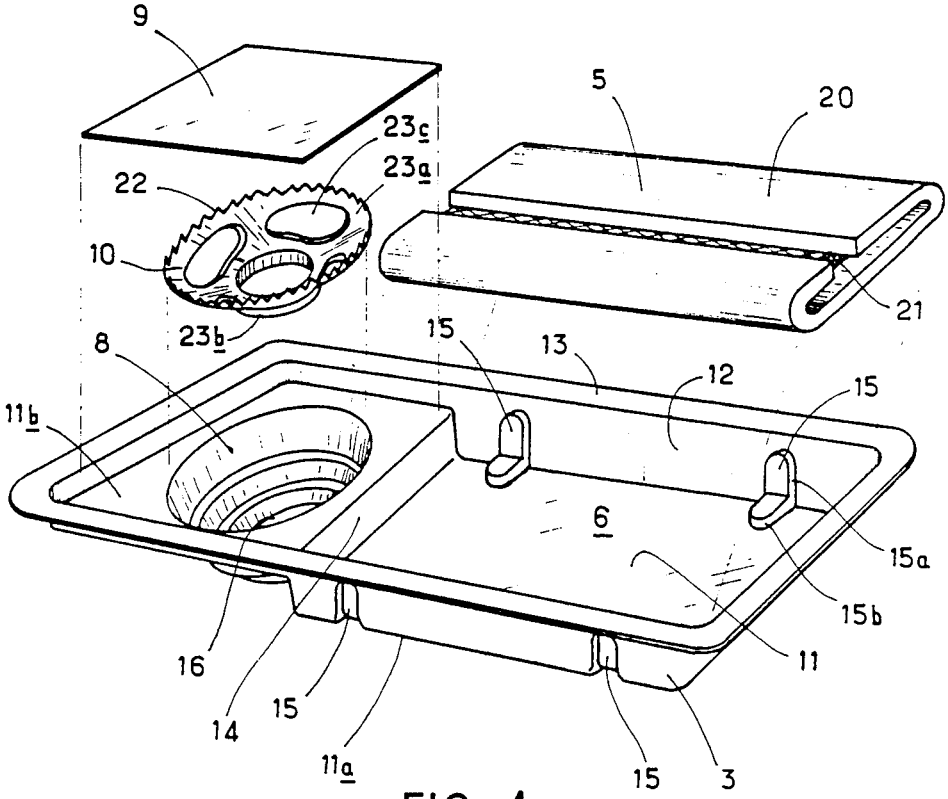
FIG. 4 is an exploded perspective view of the means of FIG. 1, the film closing the casing having been omitted.

The compartment 6 comprises internally, four protuberances 15 disposed symmetrically in pairs in relation to the longitudinal median plane of the compartment 6 which is perpendicular to the plane of the set back 14. As may be seen in FIG. 4, each of these protuberances 15 has the shape of an L having a first leg 10 carried by the corresponding element of the lateral wall 12 and on second leg 15*b* carried by the zone 11*a* of the bottom wall 11 of the said compartment 6.

The legs 15*a*, 15*b* have a flattened shape, each having a respective main face parallel to the corresponding elements of the lateral wall 12 and to the zone 11*a* of the bottom wall 11. It will also be noted that the protuberances 15 are the result of an inward deformation in the body 3 of the casing, which may be seen in FIGS. 1, 2 and 4. These protuberances 15 constitute spacing blocks for the applicator pad 5.

The zone 11*b* of the bottom wall 11 comprises, substantially at its center an outward deformation constituting a dish 16 with its axis perpendicular to the zone 11*b*. The dish 16 delimits, together with the cover 9, the compartment 8 receiving the dose of the liquid cosmetic product 7. The dish 16 comprises a lateral wall 17 joined to a bottom 18 parallel to the zone 11*b*. The lateral wall 17, flaring generally from the bottom 18 as far as its transition to the wall 11*b*, is constituted by an alternation of frustoconical zones 17*a* and zones 17*b* forming a bellows and allowing nesting of the frustoconical zones 17*a* amongst them when the bottom of the dish 18 is pressed upwardly. For this purpose each zone 17*b* comprises two successive regions with opposed concavities, the first concave towards the outside of the dish 16 and the second towards the inside, moving from the bottom 16 towards the wall 11*b*, as may be seen in FIG. 2.

The body of the casing 2 is obtained by thermoforming a plastic material of a relatively small thickness; such a manufacture does not present any difficulty. The material used may advantageously be a laminated material formed by a sheet of an ethylene/vinyl alcohol copolymer (EVOH) sandwiched between a layer of polypropylene and a layer of polyethylene. The thermoforming then constitutes a bottom wall 18 for the dish 16 having the good deformation properties desired.

The film 4 consists of a sheet of a substantially rectangular shape whose dimensions correspond to those of the external edge of the bearing surface a flange 13. It is fixed along its periphery to the flange by thermowelding. Advantageously the film 4 consists of a laminated material formed by an aluminium sheet sandwiched between a polyethylene layer and a layer of a plastic material sold under the Trade Mark "Surlyn".

Moreover, the film 4 is extended at one of its corners by a tab 19 which can be gripped by the user. Furthermore, the film 4 comprises, in its region intended to be situated opposite the cover 9 in the stored position of the storage means 1 (FIG. 2), a disc-shaped plate 4*a*, made of a relatively hard plastic material, for instance a hard polyvinyl chloride, approximately 0.5 mm thick. In the embodiment represented, the plate 4*a* is fixed to the film 4, for instance by bonding; but the said plate could also be left free between the films 4 and 9, subject to the casing comprising bosses maintaining the plate 4*a* opposite the perforator 10.

The applicator pad 5 is constituted by a rectangular strip 20 formed by a non woven material of cellulose or of polypropylene and folded back along two opposite edges around a supporting grid 21 of a rectangular shape and made of a flexible plastic material, the strip 20 being fixed to grid 21 by any suitable means.

This compartment 8 accommodates the cylindrical perforator ring 10 moulded of polypropylene. The ring 10 is cut out all along one of its edges so as to form a succession of teeth 22, intended to perforate the cover 9. The perforator ring 10 comprises a frustoconical portion 23*a* whose large edge carries the teeth 22 and, on the opposite side, a cylindrical portion 23*b*. The portion 23*a* comprises openings 23*c* to facilitate the flow of the liquid product 7.

In the stored position the ring 10 is coaxial with the dish 16, its toothed edge being opposite the cover 9 and its cylindrical portion 23*b* being received by the bottom 18 and the adjacent zone 17*a*.

Figure 2:
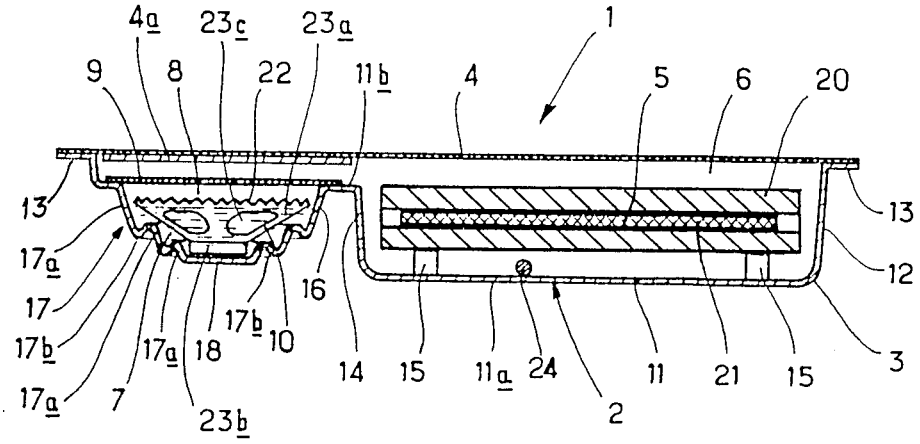
FIG. 2 is a longitudinal cross-sectional view along the line II—II of FIG. 1.
Figure 3:
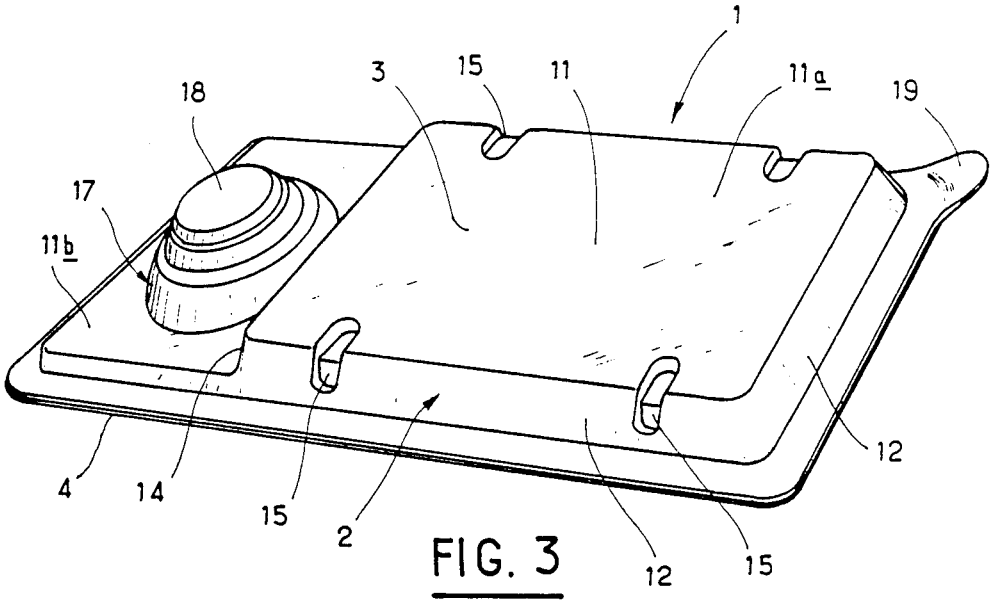
FIG. 3 is a view, similar to FIG. 1, with the storage mean inverted to show the configuration of the bottom of its casing.

Moreover, as may be seen in FIG. 2, the compartment 6 encloses a small ball 24 which is free within the said compartment 6 and whose function will be indicated below.

The manufacture and filling of the unit 1 described above are extremely simple.

Once the body 3 has been made by thermoforming, as indicated above, the ring 10 is disposed in the dish 16 into which the impregnation product 7 is then introduced. The dish 16 is closed by heat-sealing the cover 9. The pad 5 is arranged in its compartment 6, and the film 4 is fixed by thermowelding. It will be seen that all the operations can be easily automated.

When the user wishes to use the applicator pad 5, he presses upwardly on the wall 18 of the dish 16, which deforms the wall 17 by flattening it inwardly and produces the axial displacement of the perforator ring 10 towards the cover 9 which, at the end of the manipulation, becomes perforated under the action of the teeth 22 of the perforator ring 10. During this operation the film 4 remains intact because, on the one hand, the cover 9 is relatively remote therefrom and, on the other hand, if it were to come about that the pressure exerted by the user should be too great, the disc 4*a* reinforces the film 4 to prevent it being perforated.

At this instant the user vigorously shakes the unit 1 to spread the liquid 7 within the storage means 1 around and through its applicator pad 5, the ball 24 contributing to the proper agitation of the liquid 7. The presence of the blocks 15 facilitates the passage of the liquid 7 around and beneath the applicator pad 5, which will greatly promote its impregnation.

Having removed the film 4, the user removes the thus impregnated applicator pad 5 which he can then use.

Figure 5:
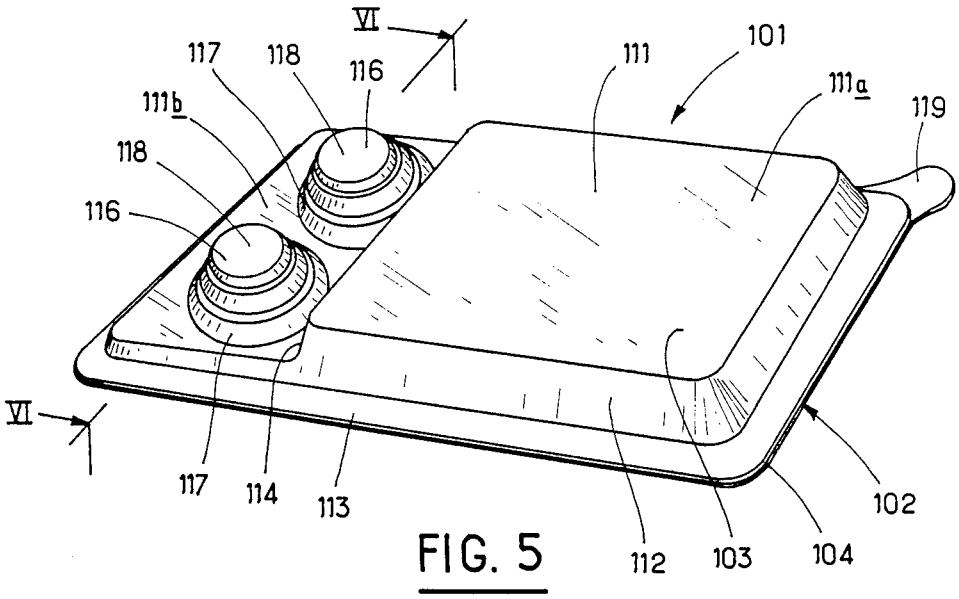
FIG. 5 is a view similar to FIG. 3 of a second embodiment of the present invention.
Figure 6:
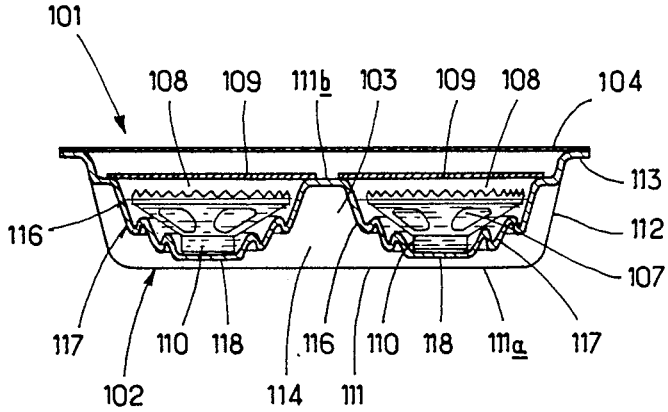
FIG. 6 is a transverse cross-sectional view along the line VI—VI of FIG. 5.
Figure 7:
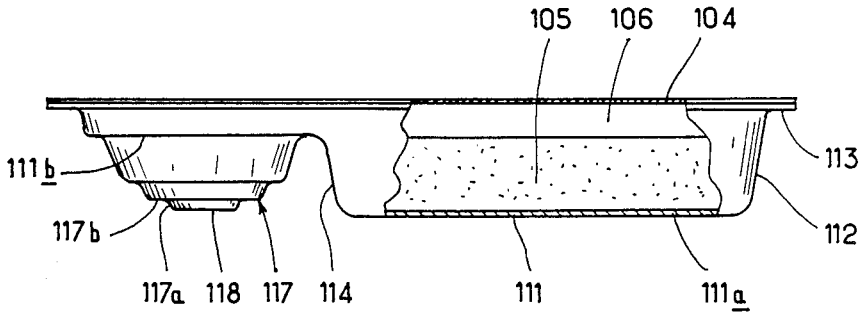
FIG. 7 is a view, similar to FIG. 2, of the first embodiment shown partly in elèvation and partly in cross section.

FIGS. 5 to 7 present a second embodiment. These elements which are identical have been represented by reference numerals increased by 100 in relation to those used for the first embodiment. Below, only the differences between these two embodiments will be described.

The compartment 106 contains a pulverulent product 105; it therefore does not comprise protuberances similar to the protuberances 15 of the first embodiment. Moreover, the wall portion 111*b* comprises two dishes 116, instead of only one, disposed in alignment with each other in the transverse direction of the body 103 of the casing 102. Each dish 116 receives a liquid product 107.

At the time of use, the manipulation of each perforator 110 produces the perforation of the associated cover 109 to spread the liquid products into the internal space of the casing 102 and mix them with the pulverulent product 105 when the storage means 101 is shaken. The user then removes the film 104 in order to extract the resultant product.

It shall be duly understood that the embodiments described above are in no way restrictive and may give rise to any desirable modifications, without thereby departing from the scope of the invention as defined by the following claims.

I claim:

1. In means for separately storing at least one basic product and at least one additional product to be contacted by the or each said basic product only at the instant of use, the said means comprising (a) casing means to contain on the one hand said at least one basic product and on the other hand at least one dose of said at least one additional product;

(b) dish means carried by the said casing means for accommodating each said dose;

(c) perforable cover means disposed within the casing and closing said dish means;

(d) perforator means normally spaced from said cover means and operative to perforate said cover means;

(e) at least one movable wall zone to said casing means accessible from outside said casing means, said at least one movable wall zone enabling relative displacement between said perforator means and said cover means to effect perforation of the cover means;

the improvement wherein (f) said at least one movable wall zone forms an integral part of the casing means, and (g) said casing means are made of a material which is sufficiently flexible for said at least one movable wall zone to be at least partly deformable under manual action of the user; wherein the said at least one product resulting from the combination of the at least one basic product must be removed for use; and wherein the casing means comprises at least one detachable wall zone for the extraction of said at least one resultant product, said casing means comprising a hollow body including an opening surrounded by an annular bearing surface to which a closing film is thermowelded to be torn off in one piece, said closing film constituting said detachable wall zone; wherein said body delimits at least two compartments of which at least one compartment receives said basic product and the other compartment contains a dish of said dish means for receiving an additional product and a perforator element of said perforator means; and wherein the cover means includes a cover associated with said dish and spaced from said closing film.

2. Means according to claim 1, wherein said dish means includes at least one dish, and said at least one movable wall zone constitutes a sunken wall zone of the casing means delimiting a dish of said dish means.

3. Means according to claim 2, wherein said perforator means constitutes at least one independent element disposed freely in the region of the casing means surrounded by an associated said movable wall zone and wherein said at least one perforator element consists of a tubular element disposed coaxially in the associated dish.

4. Means according to claim 2, wherein said at least one dish is delimited by a bottom wall which is substantially parallel to the said cover means by which it is closed and by a lateral wall constituted by an alternation of frustoconical wall zones and other wall zones forming a bellows.

5. Means according to claim 1, wherein said perforator means constitutes at least one independent element disposed freely in the region of the casing means surrounded by an associated said movable wall zone.

6. Means according to claim 1, wherein said casing means includes a wall zone which is situated opposite the cover means on the other side from the perforator means and which is reinforced or protected by an additional plate.

7. Means according to claim 1, including at least one movable element in the casing means and capable of agitating the at least one product which has a liquid to pasty or pulverulent consistency, when the products contained in said casing means are brought into contact.

8. Means according to claim 1, wherein the body comprises a bottom substantially parallel to the closing film and having a set back dividing it into first and second parts, the said first part being associated with a compartment receiving at least one said basic product and the second part being situated nearer said closing film and having at least one outward deformation constituting one of a said dish.

* * * * *